US005595129A

United States Patent [19]

Grobe

[11] Patent Number: 5,595,129

[45] Date of Patent: Jan. 21, 1997

[54] REMOVABLE SECURITY BOX

[76] Inventor: Philip R. Grobe, 5 Tone Court, Gosnells, Australia, WA 6110

[21] Appl. No.: 153,316

[22] Filed: Nov. 16, 1993

[30] Foreign Application Priority Data

Nov. 17, 1992 [AU] Australia ..... PL5899

[51] Int. Cl.[6] ..... E05G 1/00; B65D 91/00

[52] U.S. Cl. ..... 109/22; 109/66; 232/1 D; 232/15; 232/43.2

[58] Field of Search ..... 109/1 R, 2, 22–24.1, 109/45–49, 53–55, 58.5, 66, 67; 232/1 R, 1 D, 14–16, 30–32, 43.2, 51; 194/205, 206, 344, 346, 350; 271/42, 128, 131, 139, 141–143, 145, 147, 152, 160, 180, 181

[56] References Cited

U.S. PATENT DOCUMENTS

| | | | |
|---|---|---|---|
| 1,624,045 | 4/1927 | Fischer . | |
| 3,292,849 | 12/1966 | Ewing | 232/15 |
| 3,741,464 | 6/1973 | Verbeke | 232/15 |
| 3,926,366 | 12/1975 | Sciortino | 232/15 |
| 4,080,908 | 2/1978 | Bianco | 109/66 |
| 4,194,683 | 3/1980 | Finke et al. | 232/15 |
| 4,545,475 | 10/1985 | Fillod et al. | 232/15 X |
| 4,548,353 | 10/1985 | Howard et al. | 232/43.2 X |
| 4,638,746 | 1/1987 | Ishigure | 109/66 X |
| 4,790,476 | 12/1988 | Tanaka et al. | 232/1 D |
| 4,913,341 | 4/1990 | Bachman | 232/1 D |
| 5,251,738 | 10/1993 | Dabrowski | 194/206 |

FOREIGN PATENT DOCUMENTS

| | | | |
|---|---|---|---|
| B-31014/89 | 2/1991 | Australia . | |
| 667501 | 7/1963 | Canada | 109/66 |
| 2415712 | 8/1979 | France . | |
| 2484674 | 12/1981 | France | 232/1 R |
| 2639671 | 6/1990 | France | 109/66 |
| 5504 | 3/1884 | United Kingdom | 109/66 |
| 2204914 | 11/1988 | United Kingdom | 109/24.1 |

OTHER PUBLICATIONS

Australian Patent Office International–Type Search Report for Appln No. PL5899, Feb. 1993.

English Translation of French Patent No. 2,415,712, Aug. 1979.

*Primary Examiner*—Suzanne L. Dino

*Attorney, Agent, or Firm*—Merchant, Gould, Smith, Edell, Welter & Schmidt, P.A.

[57] ABSTRACT

A security box comprising a box which defines an enclosed chamber, a closure on a wall of the box to provide selective access to the chamber, a lock provided on the closure, a slot formed in a wall of the box and opening into the chamber, an elongate insert receivable in the slot, a movable platen supported within the chamber in substantially opposed relation to the slot and being movable within the chamber towards and away from the slot, and biassing means to bias the platen into face to face engagement with the internal face of the wall accommodating the slot.

19 Claims, 13 Drawing Sheets

REMOVABLE SECURITY BOX

BACKGROUND OF THE INVENTION

1. Field of the Invention

A particular application of the invention relates to a casino cash security box.

2. Description of the Prior Art

In casinos, when money in the form of notes is handed over, such notes are folded in half and are then forced through a slot in the table by a suitable board. The notes fall randomly into a box located below the slot. As a result the notes are introduced into the box in a haphazard manner and become crumpled, crushed and tangled. In addition coins and tokens are also inserted into the box which creates difficulty when it becomes necessary to sort and count the notes. Further, when such notes are counted they must be unfolded, stacked, and then placed into counting machines. This is time consuming and labour intensive.

It is an object of this invention to at least partially overcome the above disadvantages of the prior art.

SUMMARY OF THE INVENTION

In one form the invention resides in a security box which defines an enclosed chamber, a closure on a wall of the box to provide selective access to the chamber, a lock provided on the closure, a slot formed in a wall of the box and opening into the chamber, an elongate insert receivable in the slot, a movable platen supported within the chamber in substantially opposed relation to the slot and being movable within the chamber towards and away from the slot, biassing means to bias the platen into face to face engagement with the internal face of the wall accommodating the slot.

According to a preferred feature, the slot is located in an upper wall of the housing.

According to a further preferred feature of the invention, the chamber comprises a first sub-chamber which slidably accommodates the platen such that the platen extends across the sub-chamber to enclose the space defined between the walls of the sub-chamber, a second sub-chamber being located to one side of the first sub-chamber, said sub-chamber being separated by a partition, an aperture formed in the partition adjacent the slot, said insert being hollow and having a first opening formed at its outer end, a second opening formed at one side whereby said second opening will align with the aperture when the insert is received in the slot.

According to a preferred feature the security box further comprises a box shaped housing which is adapted to be fixedly mounted to a support structure, said box being receivable within the housing, a second lock provided between the housing and the box, a second slot formed in the wall of the housing to be in alignment with the first slot of the box.

According to a preferred feature of the previous feature the slot in said box is associated with a shutter which is movable across the slot between a first position closing the slot and a second position opening the slot, a biassing means biassing the shutter to its first position, said housing having a fixed element engagable with the shutter when the box is received in the housing to hold the shutter in its second position.

The invention will be more fully understood in the light of the following description of two specific embodiments. The description is made with reference to the accompanying drawings.

DESCRIPTION OF THE PREFERRED EMBODIMENTS

Figure 1:
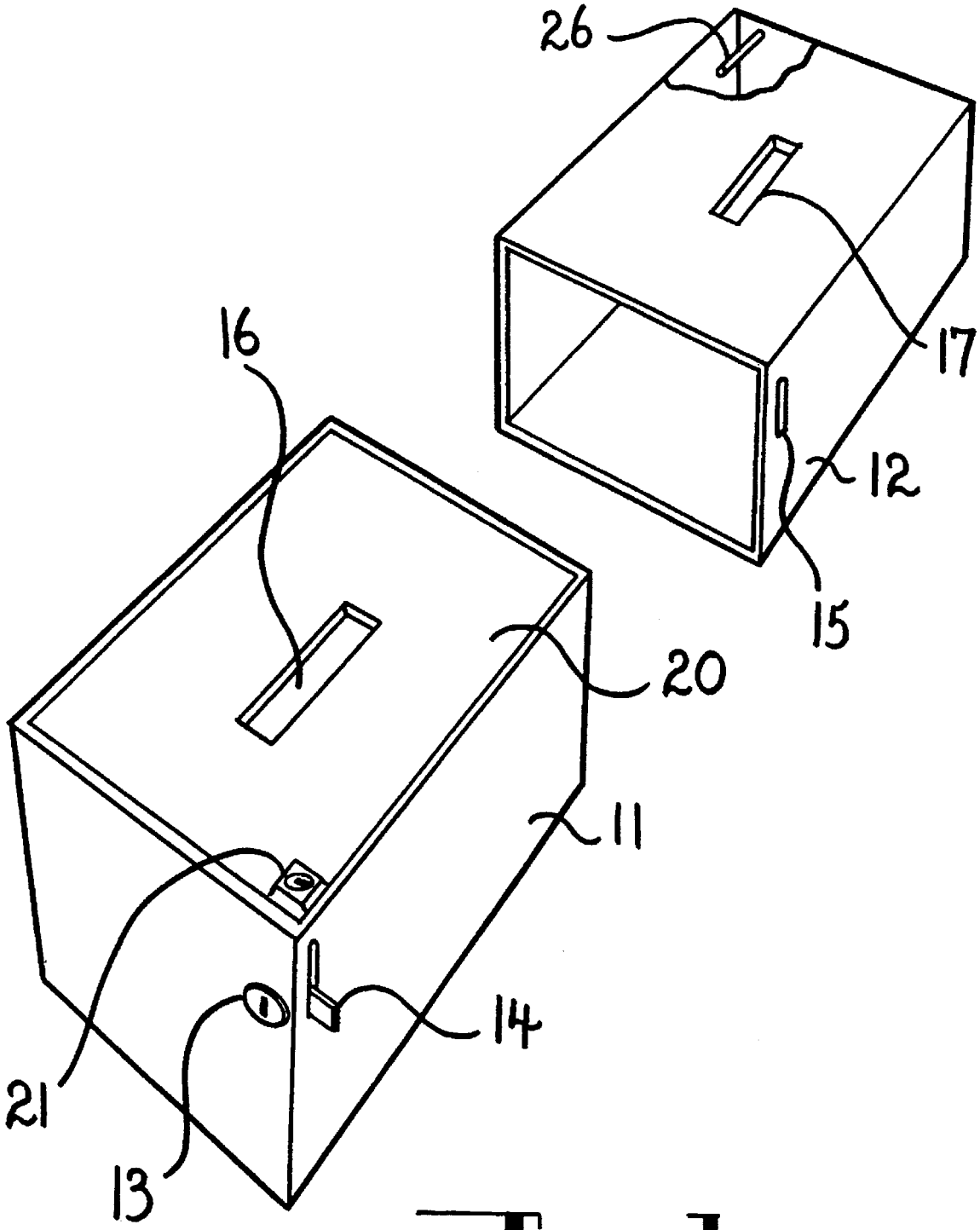
FIG. 1 is an isometric view of the security box according to the first embodiment.
Figure 2:
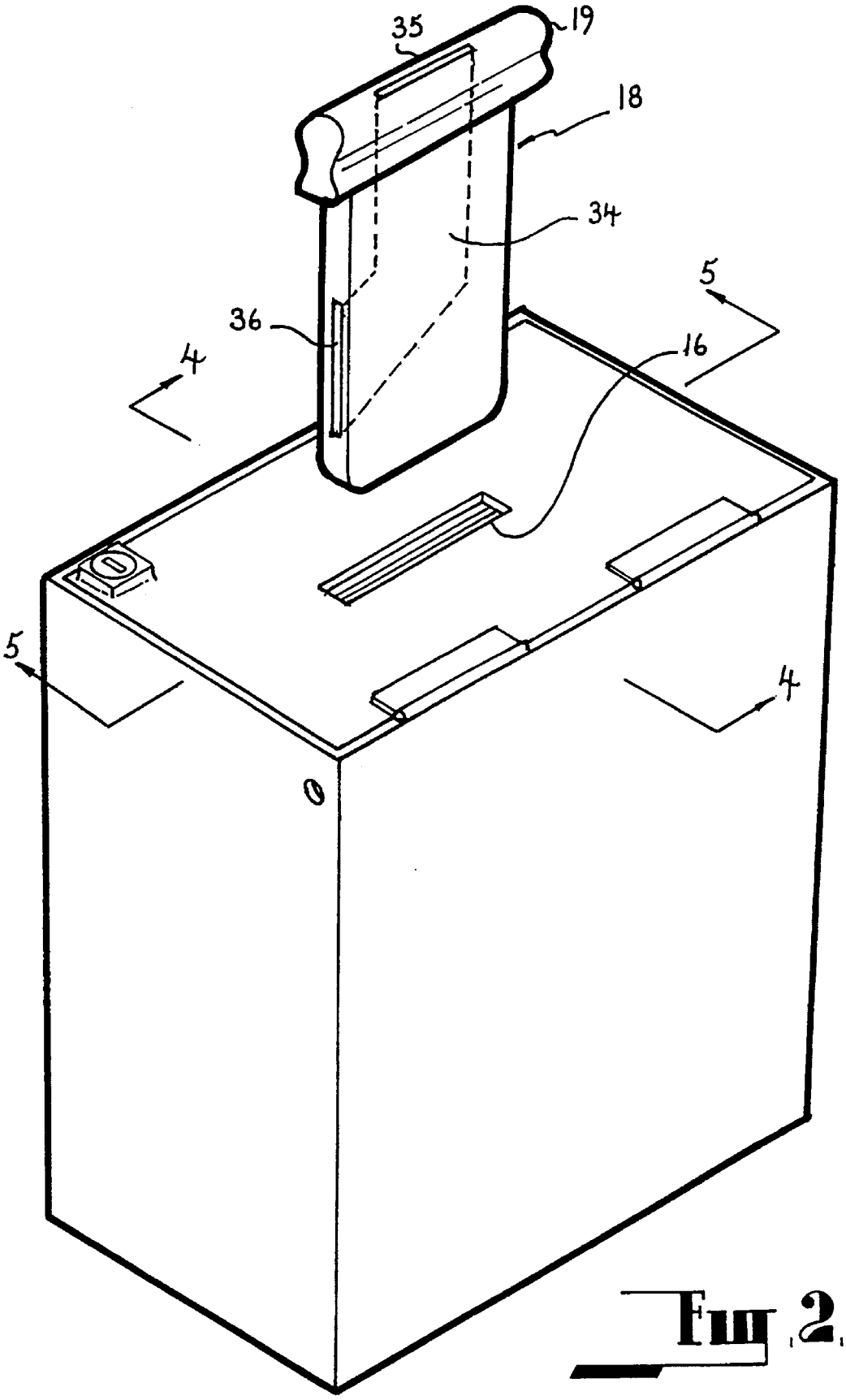
FIG. 2 is an isometric view of the security box according to the first embodiment illustrating the insert which is associated with it.

It is conventional practice in the operation of a gambling table that money is introduced into the security box through a slot provided in the gambling table and the slots in the housing and security box respectively. The notes are forced into the slot by utilisation of a paddle shaped insert 18 which has a cross-sectional profile corresponding to the configuration of the slot and which is provided at its outer end with a handle 19 whereby in use, a note is wrapped around the lower edge of the insert 18, the lower end of the insert is then introduced into the slot and the insert is firmly, positively, pushed into the slot to locate the notes which are wrapped around the lower end within the security box 11.

The first embodiment comprises a security box 11 and correspondingly shaped housing 12. The housing is adapted to be fixed to the underneath of a gambling table (not shown). The security box 11 is receivable within the housing 12 and is associated with a lock 13 having a pawl 14 which can be selectively engaged with an aperture 15 in the side wall of the housing 12 whereby on operation of the lock 13 the pawl 14 will engage in the slot 15 to retain the security box 11 in position within the housing 12. The upper wall of both the security box 11 and the housing 12 are formed with a first slot 16 and a second slot 17 respectively which are in alignment when the security box 11 is accommodated within the housing 12 and which is to be in alignment with a slot-shaped opening provided at the top of the gambling table. The upper wall 20 of the security box is hingedly supported from one side wall to provide a closure for the security box. The upper wall 20 of the security box is associated with a second lock 21 to prevent unauthorised access to the contents of the box.

Figure 3:
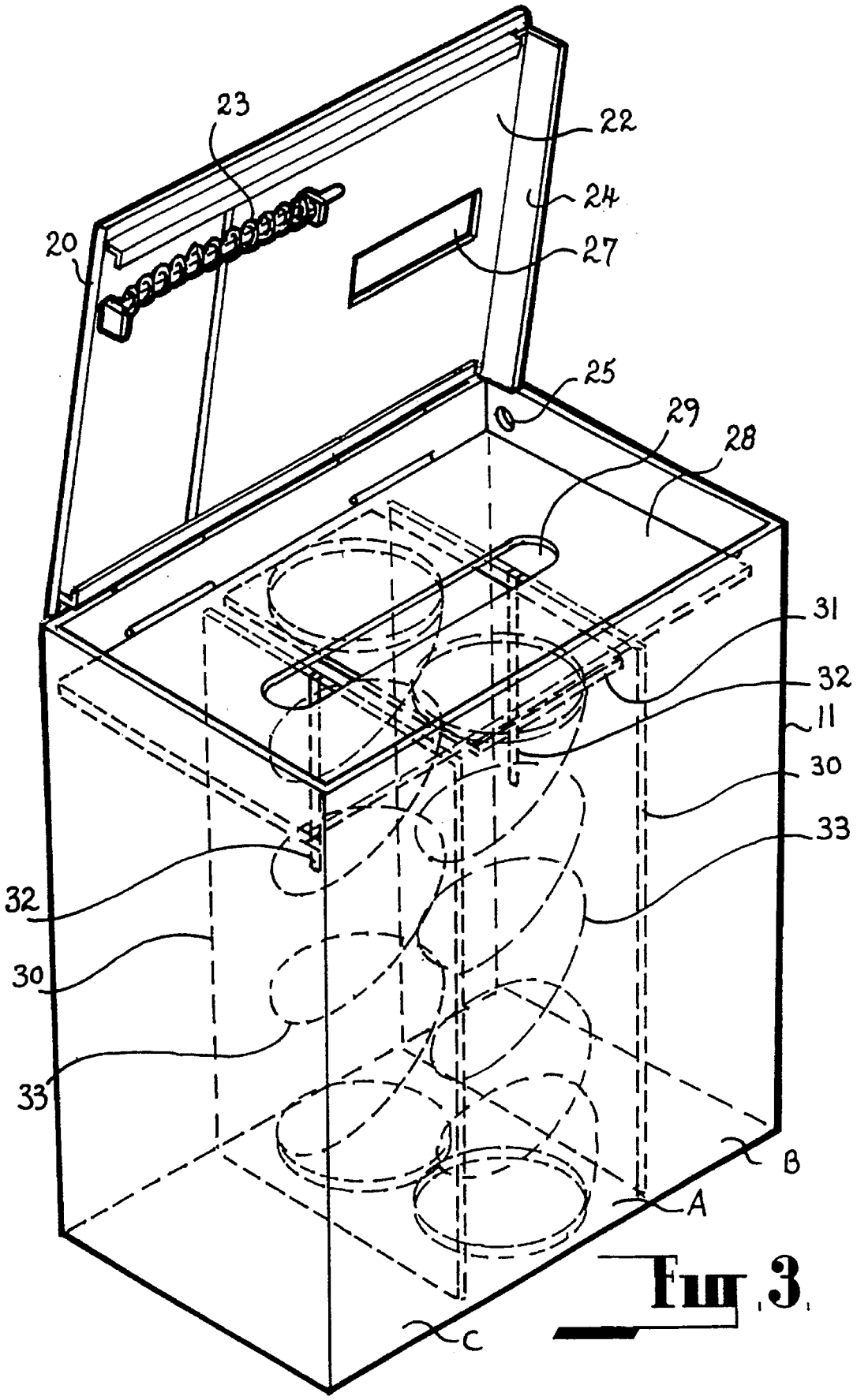
FIG. 3 is an isometric view of the security box of the first embodiment partially opened.
Figure 4:
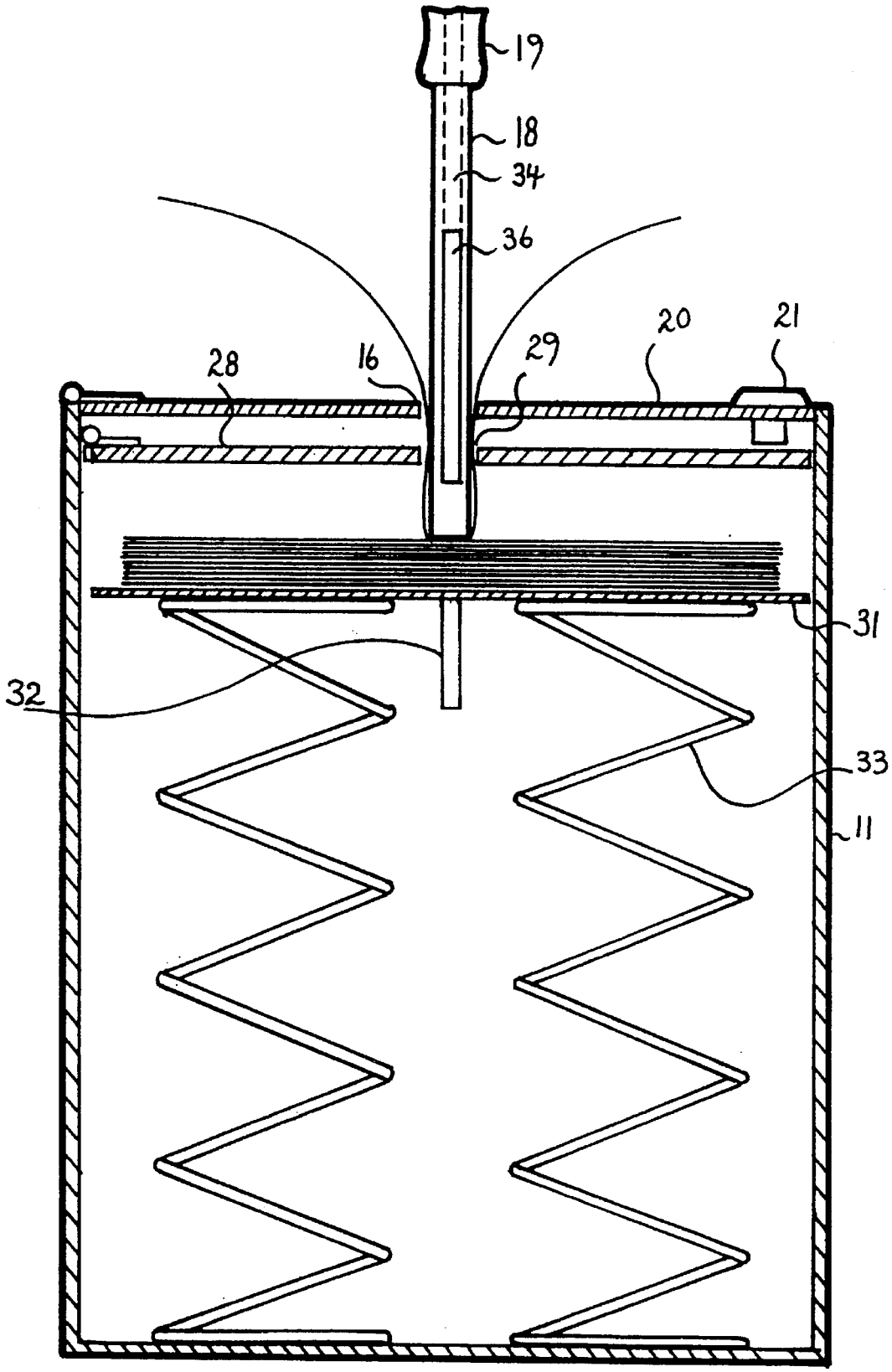
FIG. 4 is a sectional elevation of the security box according to the first embodiment along line 4—4 of FIG. 2.
Figure 5:
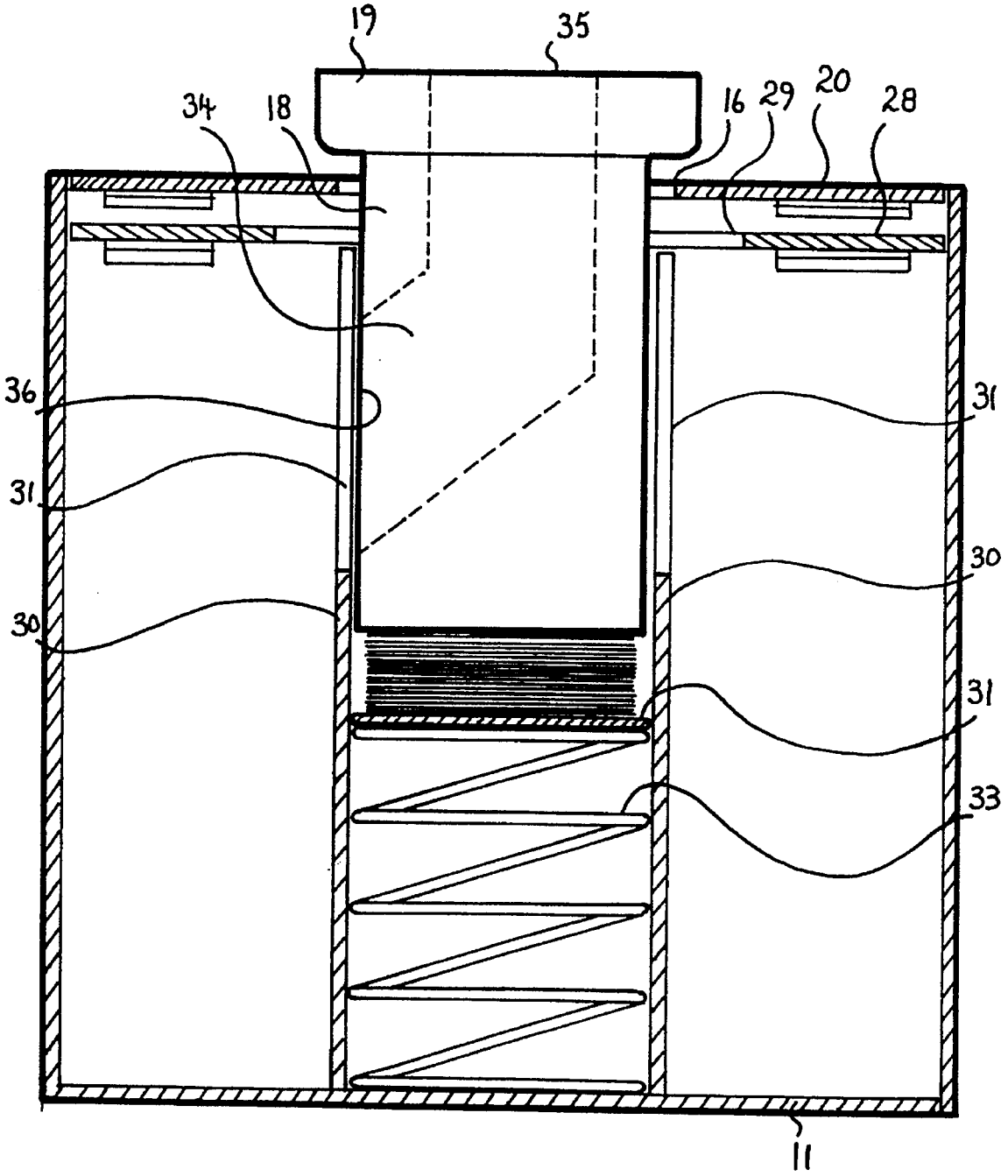
FIG. 5 is a sectional elevation along line 5—5 of FIG. 2.
Figure 6:
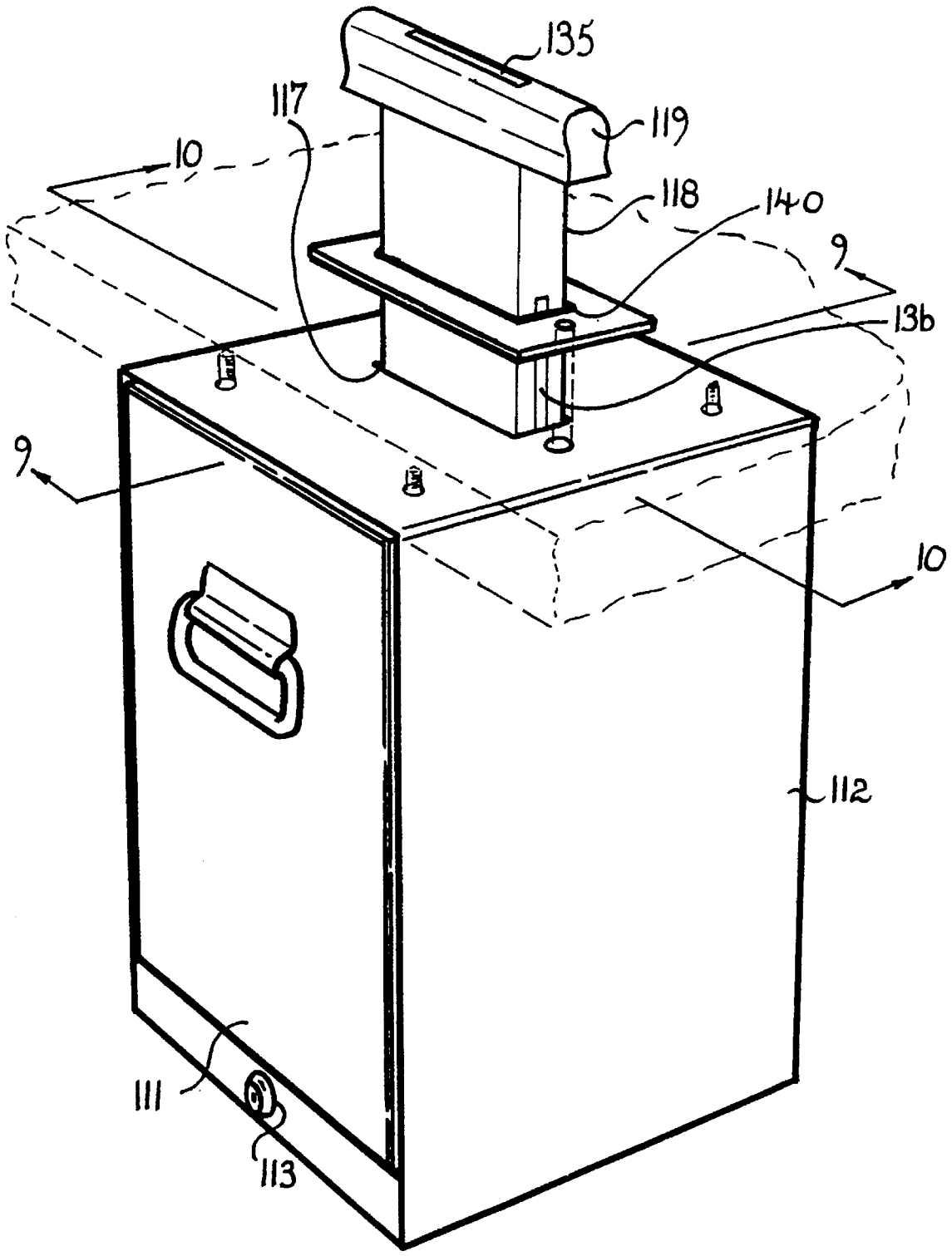
FIG. 6 is an isometric view of the second box of the second embodiment in position in a housing.
Figure 7:
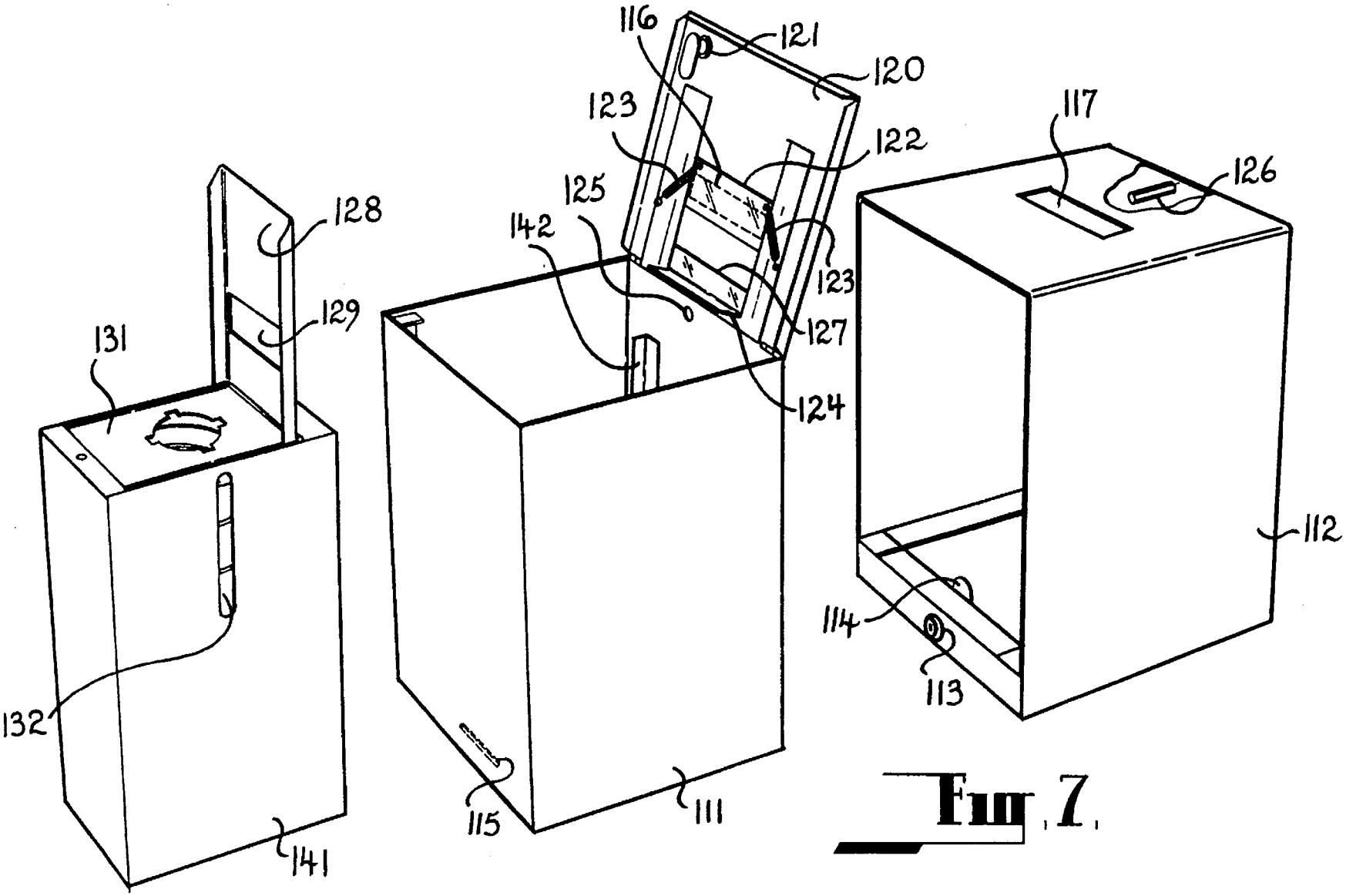
FIG. 7 is an exploded view of the second embodiment showing the housing security box and secondary box.
Figure 8:
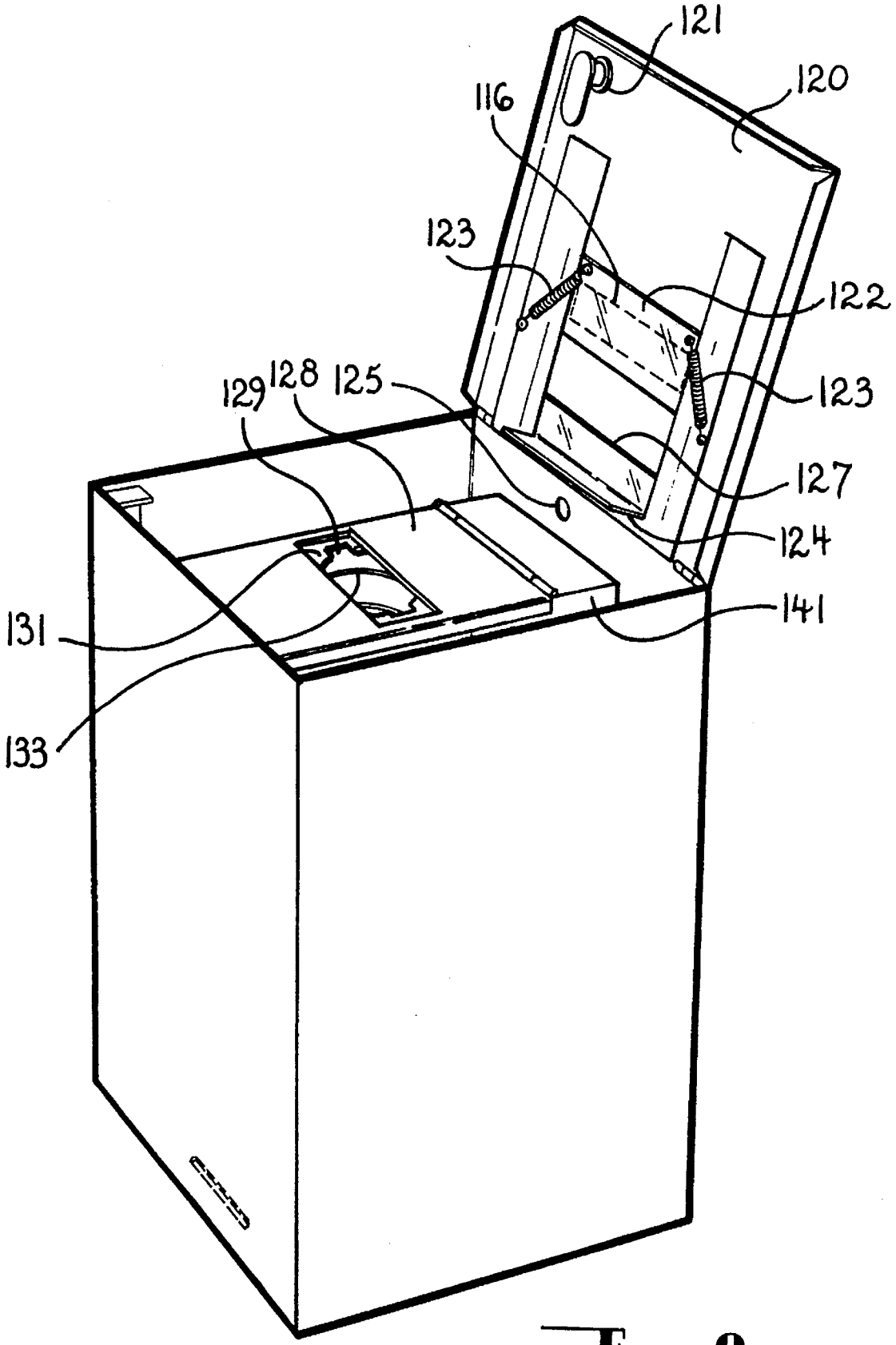
FIG. 8 is an isometric view of the security box accommodating the secondary box.
Figure 9:
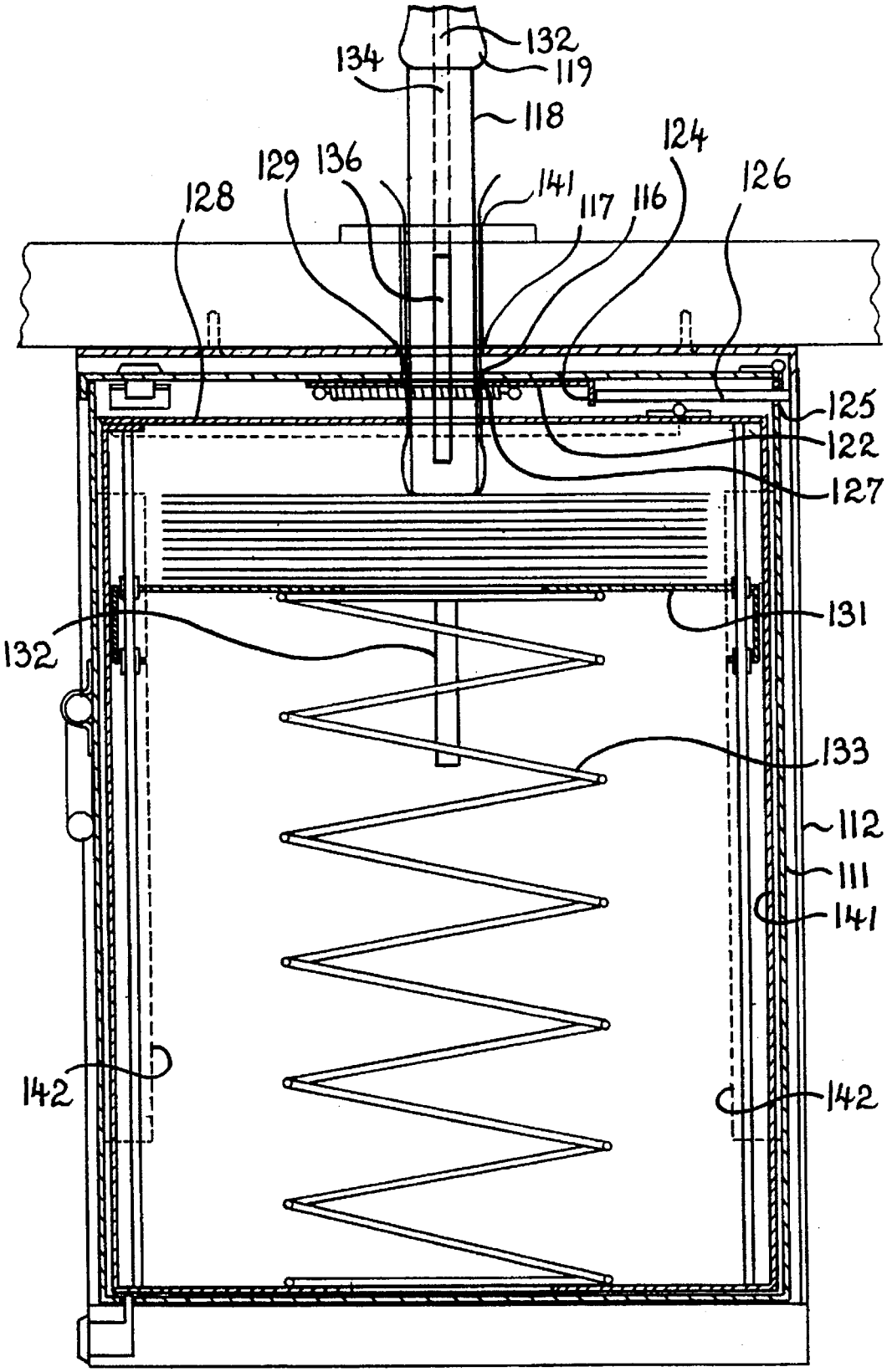
FIG. 9 is a cross sectional elevation of FIG. 6 along line 9—9.
Figure 10:
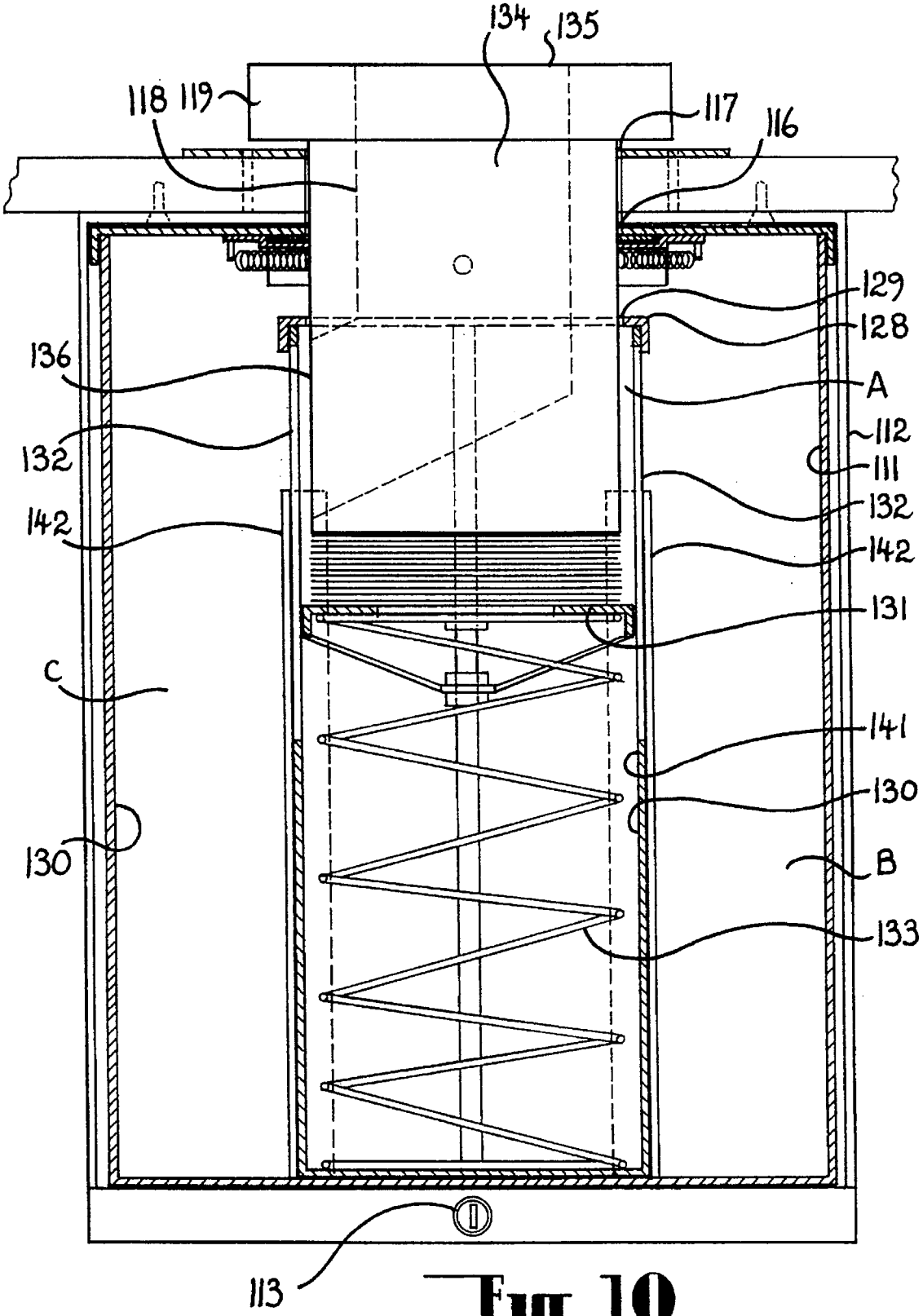
FIG. 10 is a cross-sectional elevation of FIG. 6 along line 10—10.

In addition, the undersurface of the upper wall 20 is associated with a shutter 22 in the form of a slidable panel (FIG. 3) which is formed with a third slot 27. The panel is biased by means of a coil spring 23 to a position where its slot 27 is out of alignment with the slot 16 in the upper wall 20. The shutter 22 is also formed on its outer edge with a flange 24. The side wall of the security box adjacent the upper wall 20 is formed with an aperture 25 and the interior of the housing 12 is provided with a fixed element in the form of an inwardly directed rod-shaped element 26 which is positioned such that it will be received through the aperture 25 in the wall of the security box 11 when the security box is located within the housing 12. The aperture 25 is intended to lie opposite the flange 24 of the shutter 22 when the upper wall 20 of the security box is in the closed position. On introduction of the security box into the housing, the rod shaped element 26 is caused to enter the aperture 25 and act upon the flange 24 to move the shutter 22 such that its slot 27 moves into alignment with the slot 16 in the upper wall of the security box 16.

The security box 11 is also provided with a secondary closure 28 which lies beneath the upper wall 20 and which is hingedly supported on the side wall and is provided with a suitable latching means (not shown) to retain it in its closed position across the interior of the security box 11. The secondary closure 28 is formed with a fourth slot 29 which is in alignment with the first slot 16 provided in the upper wall 20.

The chamber defined within the security box 11 below the secondary closure 28 is divided by a pair of partitions 30 into three sub-chambers comprising a central chamber A and two lateral chambers B and C. The partitions are disposed transversely to the fourth slot 29 and first slot 16 and are spaced a distance a little greater than the width of the insert 18. The central chamber A accommodates a platen 31 which substantially corresponds in area to the area of the central chamber A. The platen is slidably moveable within the central chamber A towards and away from the slot 29 provided in the secondary closure 28 and is supported within the central chamber A by a pair of springs whereby the platen is biased into face to face engagement with the interior of the secondary closure 28.

Each of the partitions 30 are provided with downwardly extending slot-shaped apertures 32 which are in vertical alignment with the first slot 16 in the upper wall 20 of the security box.

The insert 18 is dimensioned such that it is able to pass through the first slot 16 in the upper wall and the fourth slot 29 in the secondary closure 28 to engage with the platen 31 and force it into the central chamber A against the action of the spring 33. The interior of the insert 18 is formed with a passageway 34 which opens at one end into the upper face of the handle 19 via an upper opening 35 and at one side of the insert via a lateral opening 36. The passageway is dimensioned to be able to receive coins or gambling tokens.

In accordance with conventional practice, notes are introduced into the security box by wrapping the note around the lower end of the insert 18 and then introducing the insert through the slot 16 provided in the security box 11. On the insert being fully received within the security box 11, the notes will, as a result of their natural resilience, unfold. On removal of the insert 18 from the slot 16, the platen will be forced by the springs 33 against the interior of the secondary closure 28 which serves to cause the notes to be pressed flat between the platen and the interior wall of the secondary closure. As a result, the notes are stored in a relatively orderly manner and are stored in a manner which facilitates the sorting and counting of the notes on the emptying of the security box.

When it becomes necessary to deposit gambling chips, tokens or coins into the security box, the insert 18 is introduced into the slot 16 and the chips or coins are introduced into the passageway 34 within the insert 18 via the upper opening 35 where they are conveyed via the passageway to the lateral opening 36 to pass through the slot-shaped apertures 32 provided in the partitions 30 into one or other of the lateral sub-chambers B and C. Suitable guide means can be provided on the internal face of the partitions 30 to ensure accurate location of the insert and the lateral opening 36 with the respective vertical slot-shaped aperture 32 in the partitions 30. The guide means may also assist in guiding the platen in its movement in the central chamber A.

When it becomes necessary to empty the security box, the upper wall 20 is opened to provide access to the secondary lid 29 which can then be opened to provide access to the notes stored within the central chamber A. As a result of the effect of interaction of the platen within the central chamber A, the notes will be stored in a substantially pressed flat condition which would facilitate their sorting and counting. In addition, as a result of the passageway 34 provided in the insert, the coins will be accommodated separate from the notes in one or the other of the lateral sub-chambers B or C.

The second embodiment of FIGS. 6 to 10 is also directed to a cash security box which is to be used in association with gambling tables. Security box 111 is associated with a box shaped housing 112 which is to be fixed to the underneath of a gambling table (shown in phantom in FIG. 6). The security box 111 is receivable within the housing 112 and is associated with a lock 113 having a pawl 114 which can be selectively engaged with an aperture 115 in the side wall of the box 111 whereby on operation of the lock 113 the pawl 14 will engage in the slot 115 to retain the security box 111 in position within the housing 112. The upper wall of both the security box 111 and the housing 112 are formed with a first slot 116 and a second slot 117 respectively which are in alignment when the security box 111 is accommodated within the housing 112 and which is to be in alignment with a slot-shaped opening 140 provided at the top of the gambling table. The upper wall 120 of the security box is hingedly supported from one side wall to provide a closure for the security box. The upper wall 120 of the security box is associated with a second lock 121 to prevent unauthorised access to the contents of the box.

In addition, the undersurface of the upper wall 120 is associated with a shutter 122 in the form of a slidable panel which has a third slot 127. The panel is biased by means of a pair of coil springs 123 to a position where its third slot 127 is out of alignment with the first slot 116 in the upper wall 120. The shutter 122 is also formed on its outer edge with a flange 124. In addition, the side wall of the security box adjacent the upper wall 120 is formed with an aperture 125 and the interior of the housing 112 is provided with a fixed element in the form of an inwardly directed rod-shaped element 126 (see FIG. 9) which is positioned such that it is received through the aperture 125 in the wall of the security box 111 when the security box is located within the housing 112. The aperture 125 is intended to lie opposite the flange 124 of the shutter 122 when the upper wall 120 of the security box is in the closed position. On introduction of the security box 111 into the housing 112, the rod shaped element 126 is caused to enter the slot 125 and bear upon the flange 124 to move the shutter 122 such that its third slot 127 moves into alignment with the first slot 116 in the upper wall 120 of the security box 116 and the second slot 117 in the housing 112.

The security box 116 accommodates a secondary box 141 which is received between one pair of opposed side walls and has a width such that it is spaced from each of the other opposed side walls. The secondary box 141 is supported from the one pair of opposed side walls by a pair of spaced ribs 142 to lie centrally between the other pair of side walls.

The secondary box 141 is also provided with a secondary closure 128 which lies beneath the upper wall 120 of the security box and is hingedly supported from the secondary box 141 and is provided with a suitable latching means to retain it in position. The secondary closure 128 is formed with a fourth slot 129 which is in alignment with the first slot 16 provided in the upper wall 120.

Due to the presence of the secondary box 141, the space within the security box 111 is divided into three sub-chambers comprising a central chamber A and two lateral chambers B and C. The partitions between the sub-chambers which comprise the side walls of the secondary box 141 are disposed transverse to the fourth slot 129 and first slot 116 and are spaced apart a distance, a little greater than the width of the insert 118. The central chamber A accommodates a platen 131 which substantially corresponds in area to the area of the central chamber A. The platen 131 is slidably moveable within the central chamber A towards and away from the fourth slot 129 provided in the secondary closure 128 and is supported within the central chamber A from the bottom of the secondary box 141 by a spring 133 to be biased into face to face engagement with the interior of the secondary closure 128.

Each of the side walls 130 which provide the partitions between the sub-chambers A, B and C are provided with downwardly extending slot-shaped apertures 132 which are in vertical alignment with the first slot 116 in the upper wall 120 of the security box.

The security box 111 is associated with a paddle shaped insert 118 which has a cross-sectional profile corresponding to the configuration of the first slot 16 and is provided at its outer end with a handle 119 whereby in use, a note is wrapped around the lower edge of the insert 118. The insert is then introduced into the slot to firmly and positively locate the notes within the security box 111.

The insert 118 is dimensioned such that it is able to pass through the first slot 116 and fourth slot 129 in the upper wall 120 and secondary closure 128 to engage with the platen 131 and force it into the central chamber A against the action of the spring 133. The interior of the insert 118 is formed with a passageway 134 which opens at one end into the upper face of the handle 119 via an upper opening 135 and at one side of the insert via a lateral opening 136.

In accordance with conventional practice, notes are introduced into the security box by wrapping the note around the lower end of the insert 18 and then introducing the insert through the slot shaped opening 140 in the gambling table, the second slot 117 in the housing 112, the first slot 116 in the security box 11, and the third slot 129 in the secondary box 141. On the insert being fully received within the security box 111 and secondary box 141, the notes will, as a result of their natural resilience, unfold. On removal of the insert 118 from the slots 116, 127 and 129, the platen will be forced by the spring 133 against the interior of the secondary closure 128 which serves to cause the notes to be pressed flat between the platen and the internal wall of the secondary closure 128. As a result, the notes are stored in a relatively orderly manner and are stored in a manner which facilitates the sorting and counting of the notes on the emptying of the security box. When it becomes necessary to deposit gambling chips, tokens or coins into the security box, the insert 118 is introduced into the slots 116, 117, 127 and 129 and the chips or coins are introduced into the passageway 134 within the insert 118 via the upper opening 135 where they are conveyed via the passageway to the lateral opening 136 to pass through the slot-shaped apertures 132 provided in the side walls 130 of the secondary box 141 into one or other of the lateral sub-chambers B and C. Suitable guide means can be provided on the internal face of the side walls 130 to ensure accurate location of the insert and the lateral opening 136 with the respective vertical slot-shaped aperture 132 in the side walls 130.

When it becomes necessary to empty the security box, the upper wall 120 is opened to provide access to the secondary box 141 which can then be removed and opened to provide access to the notes stored within it. As a result of the effect of interaction of the platen within the secondary box 141, the notes will be stored in a substantially pressed flat condition which would facilitate their sorting and counting. In addition, as a result of the passageway 134 provided in the insert, the coins will be accommodated separate from the notes in the security box 111.

Figure 11:
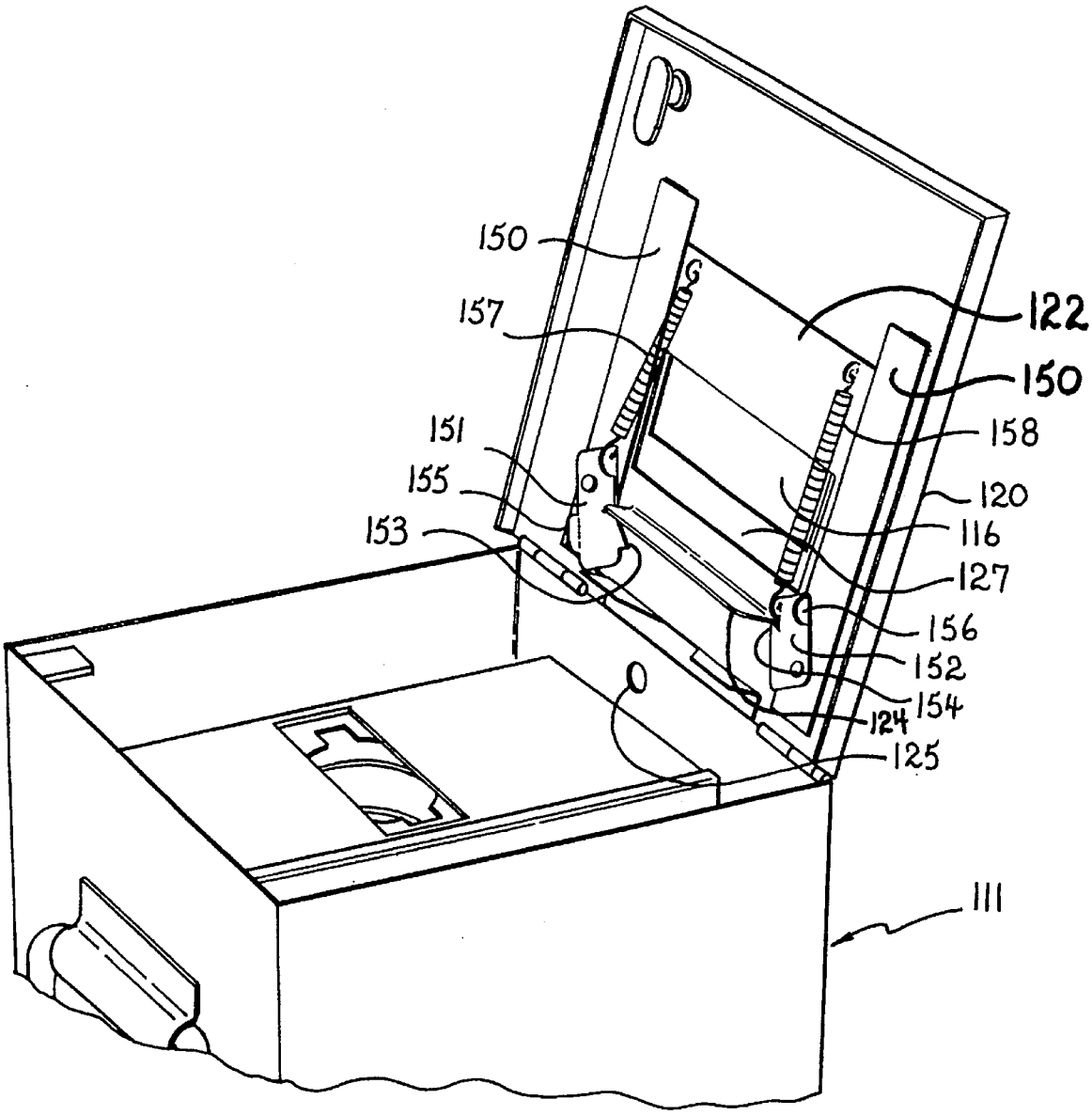
FIG. 11 is an illustration of a form of locking means for locking the shutter in position.
Figure 12A:
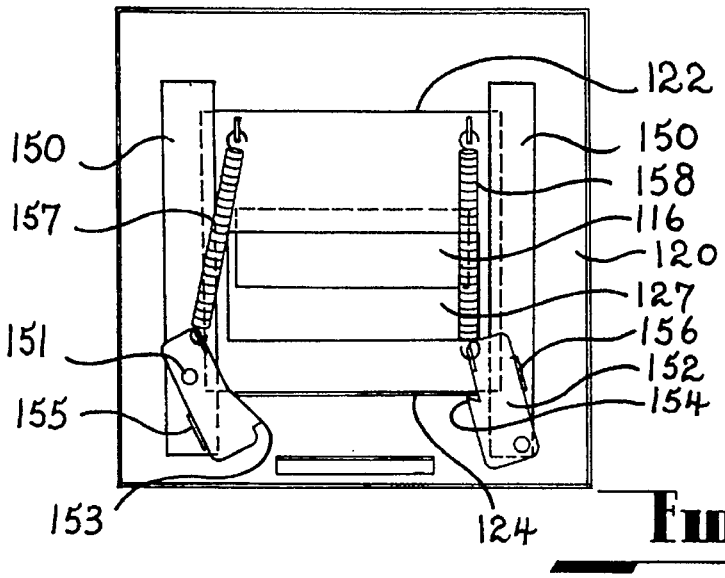
FIGS. 12 *a, b* and *c* are inverted plan views of the upper wall 120 which illustrate the various locked positions of the shutter.
Figure 12B:
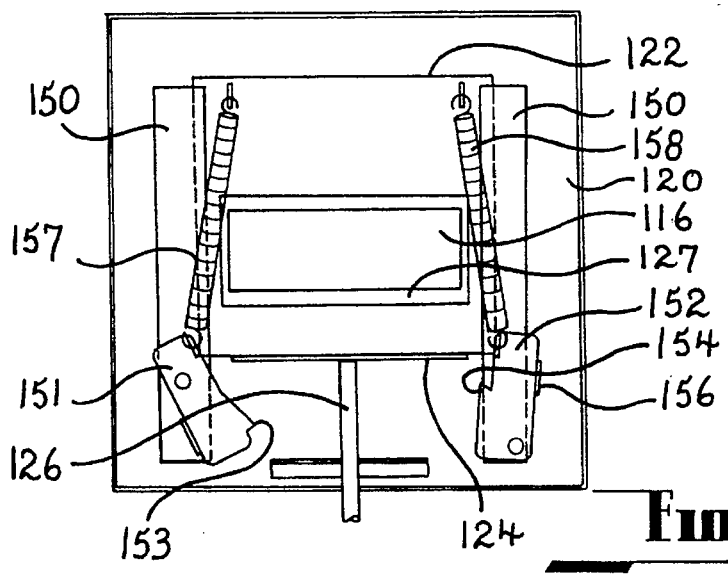
Figure 12C:
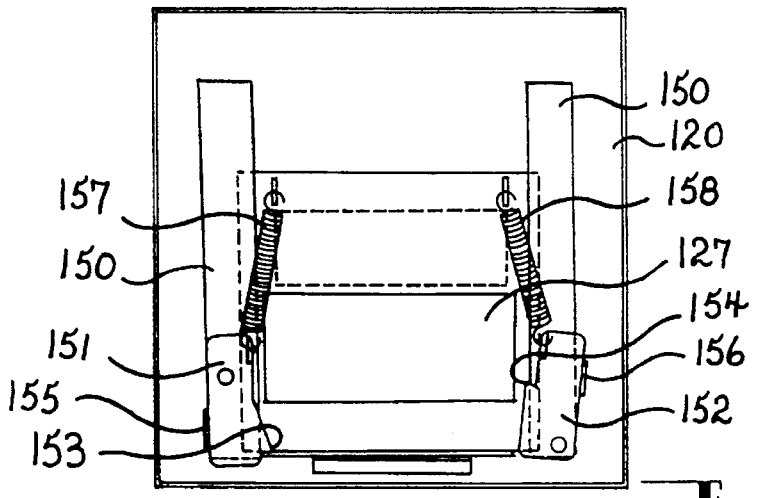

FIGS. 11 and 12 illustrate a locking means for the shutter 22 and 122 of the first and second embodiments whereby the shutter can be retained in position across the aperture 25 and 125 in the upper wall 20 and 120 respectively.

The locking means will be described in relation to the second embodiment.

The shutter 122 is slidably supported from the underside of the upper wall 120 between a pair of opposed channels 150. The shutter as discussed previously is formed with a third slot 127 and on its slidable movement across the upper wall 120 it can be brought into and out of alignment with the first slot 116 in the upper wall 120. The shutter 122 is formed at one side with a flange 124.

To lock the shutter a pair of pawl members 151 and 152 are pivotally mounted in opposed relation to the channels 150 and are each formed with a pawl 153 and 154 which will engage the flange 124 on the shutter when at either of its end positions. The first pawl 153 on the first pawl member 151 is intended to engage the flange 124 when the shutter is in its closed position at which position the third slot 127 is out of alignment with the first slot 116. The first pawl member 151 is also formed with a tab 155 which enables manipulation to cause the first pawl to be disengaged from the flange 124. The second pawl on the second pawl member 152 engages the flange 124 to retain the shutter in the open position when the third slot 127 is aligned with the first slot 116. A tab 156 is provided on the second pawl member to enable the second pawl to be manipulated out of engagement or into engagement with the flange 124. A spring 157 and 158 is mounted between each pawl member 151 and 152 respectively and the shutter to bias the shutter to the closed position and the first and second pawl members into and out of engagement with the flange 124 respectively.

In use, when the security box is to be installed, the upper wall is opened and the first pawl 153 is disengaged from the flange 124 and the shutter 122 is moved to the open position where the second pawl 154 is engaged with the flange 124 to retain the shutter in the open position. When the security box 111 is located in the housing 112, the rod shaped element 126 enters the aperture 125 in the side wall of the security box 111 and bears on the flange 124 to retain the shutter 122 in the open position and allow the second pawl 154 to disengage from the flange 124 whereby the second pawl member under the influence of the second spring 158 moves clear of the shutter. When the security box 11 is removed from the housing 112, the shutter under the influence of the spring 157 and 158 moves to the closed position where the flange is lockingly engaged by the first pawl 153. As stated above, the shutter locking arrangement described above can be used with either of the first or second embodiments.

Figure 13:
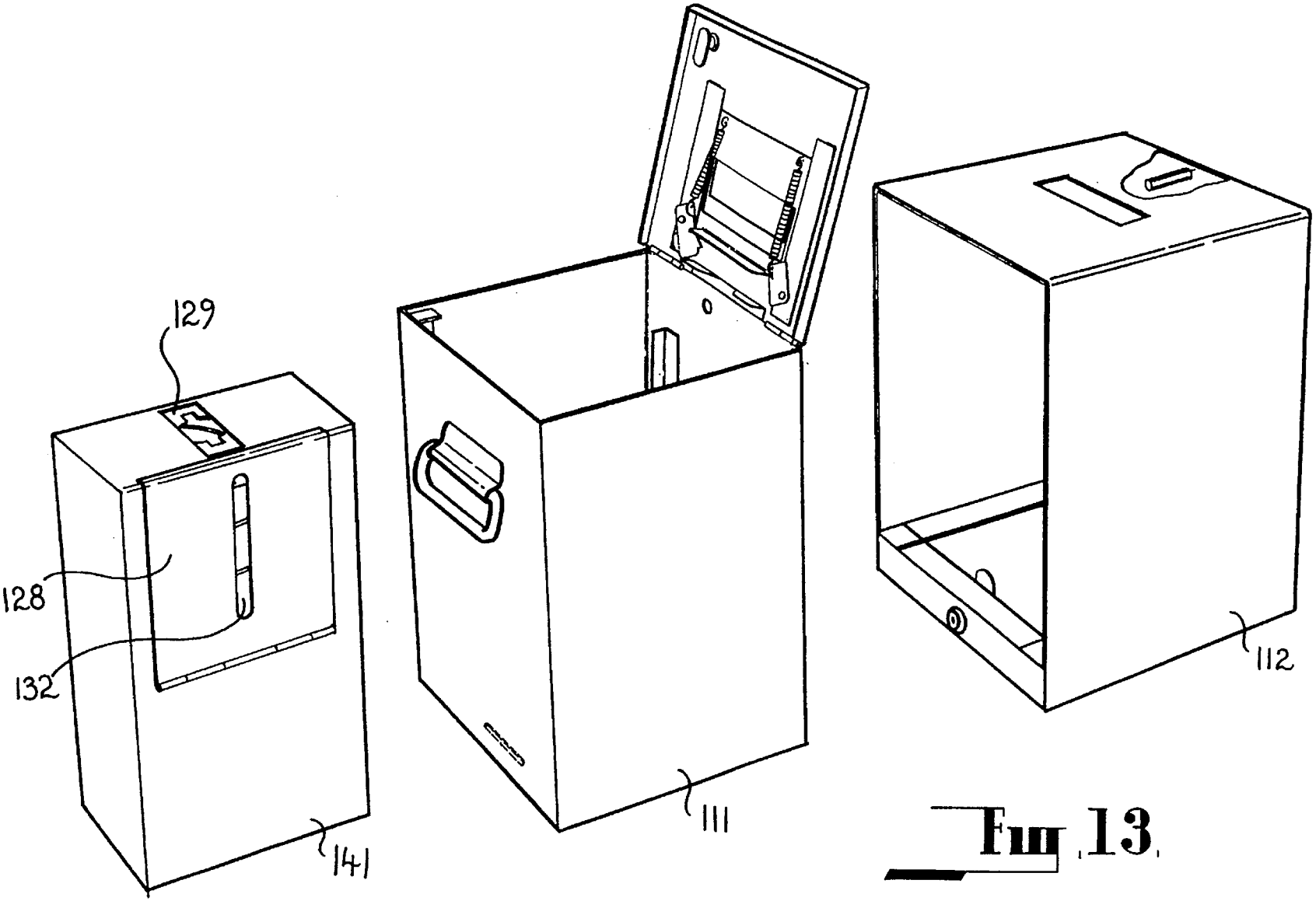
FIG. 13 is an exploded view of a third embodiment.

FIG. 13 illustrates a third embodiment which is a variation of the second embodiment. The variation relates to the secondary box 141 where access to the contents of the secondary box is gained through a closure 128 provided on the side wall of the secondary box rather than the top wall. In addition, the shutter 122 is associated with a locking arrangement of the form described in relation to FIGS. 11 and 12.

It should be appreciated that the scope of the present invention need not be limited to the particular scope of the embodiment described above. In particular, the embodiment could be used in association with any form of security box where paper articles are to be securely stored such as in ballot boxes and the like.

I claim:

1. A security box comprising a box which defines an enclosed chamber wherein the chamber comprises a first sub-chamber and a second sub-chamber located to one side of the first sub-chamber and separated from the first sub-chamber by a partition, a closure in a wall of the box to provide selective access to the chamber, a lock provided on the closure, a first slot formed in a wall of the box opening into the first sub-chamber, a moveable platen supported within the first sub-chamber in substantially opposed relation to the first slot and being moveable within the first sub-chamber towards and away from the first slot, biasing means to bias the platen into face-to-face engagement with an internal face of the wall accommodating the first slot, an elongate insert receivable in the first slot, said insert having a cross-sectional configuration substantially corresponding to the shape of the first slot and having one end which is outermost when the insert is in engagement with the first slot and another end which is within the chamber when the insert is in engagement with the first slot, said insert having a passageway extending between a first opening at the one end and a second opening in a side of the insert, said second opening communicating with the second sub-chamber when the insert is fully received in the first slot, said passageway being intended to receive coins or tokens.

2. A securing box as claimed at claim 1 wherein the second sub-chamber comprises two sub-chambers, one to each side of the first sub-chamber.

3. A security box as claimed at claim 1 wherein the first sub-chamber is formed as a removable box-shaped enclosure which is receivable within the chamber.

4. A security box as claimed at claim 3 further comprising a box-shaped housing which is adapted to be fixedly mounted to a support structure, said box being received within the housing, a second lock provided between the housing and the box, a second slot formed in a wall of the housing in alignment with the first slot of the box when the box is received within the housing.

5. A security box as claimed at claim 4 wherein the first slot is associated with a shutter which is moveable across the first slot between a first position closing the first slot and a second position opening the first slot, a biasing means biasing the shutter to the first position, said housing having a fixed element engageable with the shutter when the box is received in the housing to hold the shutter in the second position.

6. A security box as claimed at claim 5 wherein the shutter is associated with a locking means which engages the shutter when in the first position and which is disengaged to enable movement to the second position.

7. A security box as claimed at claim 4 wherein the first slot is located in an upper wall of the box.

8. A security box as claimed at claim 7 wherein the first slot is provided in the closure.

9. A security box as claimed at claim 3 wherein the first slot is associated with a shutter which is moveable across the first slot between a first position closing the first slot and a second position opening the first slot, a biasing means biasing the shutter to the first position, said housing having a fixed element engageable with the shutter when the box is received in the housing to hold the shutter in the second position.

10. A security box as claimed at claim 9 wherein the shutter is associated with a locking means which engages the shutter when in the first position and which is disengaged to enable movement to the second position.

11. A security box as claimed at claim 5 wherein the shutter has a third slot formed therein, said third slot being aligned with the first slot when the shutter is in the first position and not being aligned with the first slot when the shutter is in the second position.

12. A security box as claimed at claim 3 wherein two second sub-chambers are provided, one to each side of the first sub-chamber.

13. A security box as claimed at claim 1 wherein the first sub-chamber is closed by a second closure having a slot shaped aperture in alignment with the first slot.

14. A security box as claimed at claim 2 further comprising a box-shaped housing which is adapted to be fixedly mounted to a support structure, said box being receivable within the housing, a second lock provided between the housing and the box, a second slot formed in a wall of the housing to be in alignment with the first slot of the box when the box is received within the housing.

15. A security box as claimed at claim 14 wherein the first slot is located in an upper wall of the box.

16. A security box as claimed at claim 15 wherein the first slot is provided in the closure.

17. A security box as claimed at claim 2 wherein the first slot is associated with a shutter which is moveable across the first slot between a first position closing the first slot and a second position opening the first slot, a biasing means biasing the shutter to the first position, said housing having a fixed element engageable with the shutter when the box is received in the housing to hold the shutter in the second position.

18. A security box as claimed at claim 17 wherein the shutter is associated with a locking means which engages the shutter when in the first position and which is disengaged to enable movement to the second position.

19. A security box as claimed at claim 17 wherein the shutter has a slot shaped opening formed therein, said slot shaped opening being aligned with the first slot when the shutter is in the first position and not being aligned with the first slot when the shutter is in the second position.

* * * * *

UNITED STATES PATENT AND TRADEMARK OFFICE
CERTIFICATE OF CORRECTION

PATENT NO. : 5,595,129

DATED : 21 January 1997

INVENTOR(S) : Grobe

It is certified that error appears in the above-identified patent and that said Letters Patent is hereby corrected as shown below:

On the title page item [76],
[Inventor] "Philip" should read --Philipp--.

Column 2, Line 31 [new paragraph] --The first embodiment is directed to a cash security box ich is to be used in association with gambling tables. Conventionally the security box is ociated with a box shaped housing which is fixed to the underneath of the gambling table. A slot ormed in the gambling table housing and all of the slots are in alignment when the security box is position in the gambling table.--.

Signed and Sealed this

Sixth Day of January, 1998

*Attest:*

*Attesting Officer*

BRUCE LEHMAN

*Commissioner of Patents and Trademarks*